US005099671A

United States Patent [19]

Beaulac

[11] Patent Number: 5,099,671

[45] Date of Patent: Mar. 31, 1992

[54] COMBINATION BRAKING, PUNCHING AND SHEARING APPARATUS FOR FORMING SHEET METAL STRIPS

[76] Inventor: Russ Beaulac, 1111 S. Coast Dr., No. D202, Costa Mesa, Calif. 92626

[21] Appl. No.: 670,729

[22] Filed: Mar. 18, 1991

[51] Int. Cl.[5] ..... B21D 5/00; B21D 28/24

[52] U.S. Cl. ..... 72/331; 72/294; 72/319; 72/335; 83/214; 83/682; 83/649

[58] Field of Search ..... 72/331, 326, 327, 339, 72/335, 333, 294, 319; 29/897, 897.3, 172; 83/214, 255, 681, 682, 649

[56] References Cited

U.S. PATENT DOCUMENTS

| | | | |
|---|---|---|---|
| 494,535 | 3/1893 | Vanstone | 72/333 |
| 1,379,005 | 5/1921 | Eligh | 72/335 |
| 1,423,586 | 7/1922 | Throne | 72/333 |
| 1,526,518 | 2/1925 | Wentworth | 72/335 |
| 1,529,387 | 3/1925 | Anderson | 72/335 |
| 1,573,810 | 2/1926 | Cunningham | 72/331 |
| 2,210,062 | 8/1940 | Campbell | 29/897 |
| 2,460,281 | 2/1947 | Garberding | 72/331 |
| 3,248,988 | 5/1966 | Janczy | 83/682 |

FOREIGN PATENT DOCUMENTS

| | | | |
|---|---|---|---|
| 369064 | 10/1907 | France | 72/327 |

*Primary Examiner*—Daniel C. Crane

[57] ABSTRACT

Apparatus is provided for forming strips of sheet metal into supports or hangers for ducts and the like. The apparatus comprises a reel for holding a coil of sheet metal for being formed into strips, a strip feeder for extracting lengths of sheet metal from a coil of sheet metal held in the reel, and a combination brake, punch and shear mounted on the reel for causing a 90 degree bend in a portion of the strip near the end to be sheared off, for punching at least one hole in, and for shearing, each of the extracted lengths of sheet metal from the coil, the combination brake, punch and shear being configured for causing the bending, punching and shearing with a single operational stroke, a hole being punched in the extracted length of sheet metal between the bend and shear lines before the bend is made and before the strip is sheared form the coil of sheet metal. The strip feeder comprises a pair of rollers between which sheet metal from the coil is passed so as to be advanced from the coil in response to rotation of the rollers in a strip advancing direction, and including a manual crank for causing the rotation of the rollers in a sheet metal advancing direction, rotation of the rollers being calibrated so that a given rotation of the rollers causes the extraction of a known length of sheet metal from the coil.

13 Claims, 4 Drawing Sheets

COMBINATION BRAKING, PUNCHING AND SHEARING APPARATUS FOR FORMING SHEET METAL STRIPS

BACKGROUND OF THE INVENTION

1. Field of the Invention

The present invention relates generally to the field of sheet metal forming apparatus and, more particularly, to brakes, punches and shears for forming and cutting strips of sheet metal.

2. BACKGROUND DISCUSSION

Various types of sheet metal forming tools and apparatus are known in the art. These tools and apparatus include what are commonly called sheet metal brakes by means of which pieces of sheet metal are rapidly and easily bent along a straight line to form, for example, flanges along edges of the sheet metal pieces. As an alternative to such sheet metal brakes, blocks, usually of wood, and a hammer may be used to manually bend over portions of a piece of sheet metal. However, the use of blocks and a hammer to form a sheet metal bend is slow and usually does not provide a smooth, uniform and straight bend in sheet metal. Moreover, the use of blocks and a hammer to hand-bend sheet metal id slow and requires considerable energy unless the sheet metal is very thin.

Another familiar sheet metal apparatus is a mechanical sheer, constructed somewhat similarly to a guillotine, by means of which sheets or strips of sheet metal are smoothly sheared along a long straight line. Such mechanical shearing apparatus may be manually operated or may, for large sheets of relatively thick sheet metal, be power-operated, and are distinguished from sheet metal hand shears in that the mechanical shearing apparatus are configured for shearing even wide pieces of sheet metal with a single stroke of an elongate cutting blade; whereas, hand-held sheet metal shears make only short cuts with each shearing strike. As a result, hand-held sheet metal shears not only require more effort to cut a wide piece of sheet metal but also provide, even with careful use, an uneven cut with sharp barbs often being formed along the cut between the individual cuts.

Various apparatuses and machines are also known for making holes in sheet metal. Such holes may, of course, be drilled using conventional drill motors and drill bits; however, holes made in this manner often have jagged edges and are out of round. In any event, the drilling of holes in the sheet metal is usually unsatisfactory, since the surrounding regions of the sheet metal may be distorted or torn. The punching of holes is usually more satisfactory for sheet metal, especially thin sheet metal, and is the means most often used. Such hole punches for sheet metal may be constructed to punch either single holds or a plurality of holes at once, and may be manually or power operated.

In some special instances, however, it may be desirable from a production standpoint, to perform braking, punching and shearing operations on strips of sheet metal by means of a single operating stroke. Such braking, punching and shearing of sheet metal strips would be particularly advantageous and time-saving when the production of a large number of similar or identical sheet metal pieces having bends and punched holes is required to be made. Requirements for such similar sheet metal pieces may, for example, be straps for attaching heating and/or air conditioning ducts to building structures.

So far as is known to the present inventor, however, no such combination sheet metal braking, punching and shearing apparatus is available for the production of numbers of straps from, for example, standard coils or rolls of sheet metal. It is, therefore, a principal objective of the present invention to provide such an apparatus.

SUMMARY OF THE INVENTION

In accordance with the present invention there is provided an apparatus for forming strips of sheet metal into straps. The apparatus comprises reel means for holding a coil of sheet metal for being formed into strips and sheet metal strip feeding means associated therewith for extracting (pulling) lengths of sheet metal from a coil of sheet metal held in the reel, the extracting means, which may comprise rollers between which the sheet metal from the coil is passed in a driven relationship, enabling the extracting of predetermined lengths of sheet metal strips from the coil of sheet metal when the rollers are driven in a strip advancing direction. Further comprising the apparatus are combination punching and shearing means which are operatively associated with the reel and the feeding means, and are preferably mounted on the reel means. The combination punching and shearing means are constructed for punching at least one hole at each extracted length of sheet metal and for shearing each length of sheet metal which is extracted by the feeding means from the coil of sheet metal, the punching and feeding means being configured for causing such punching and shearing with a single operational stroke.

Preferably, the combination punching and shearing means are configured for punching a hole in each extracted length of sheet metal relatively adjacent to the line at which such lengths of sheet metal are to be sheared from the coil of sheet metal. It is also preferred that the punching and shearing means are configured for punching a hole in each of extracted length of sheet metal before it is sheared from the coil of sheet metal. Advantageously, the combination punching and shearing means are further configured for enabling different sizes of hole punches to be installed therein, so as to enable holes of different sizes to be punched through the extracted lengths of sheet metal.

In accordance with a preferred embodiment of the invention, the combination punching and shearing means include braking means for causing the bending over, preferably through an angle of about 90 degrees, of one region of each extracted length of sheet metal relative to the rest of the length before the extracted length is sheared from the coil of sheet metal, but on the same operating stoke on which the extracted length of sheet metal is punched and sheared. Preferably, the region of the extracted length of sheet metal is to be sheared from the coil of sheet metal and is preferably on the side of the punched hole away from the shearing line so that the punched hole is in the bent-over end or flange of the extracted length.

By operation of the disclosed and claimed apparatus, a length, preferably a measured length, of sheet metal which has been extracted from a coil of sheet metal is sequentially punched, bent and sheared all in a single operating stroke. Accordingly, a number of formed strips of sheet metal can be formed, for example, into duct supports, in a rapid, easy and economical manner.

BRIEF DESCRIPTION OF THE DRAWINGS

The present invention can be more readily understood by a consideration of the following detailed description when taken in conjunction with the accompanying drawing, in which.

In the various FIGS. like elements and features are given the same reference number and/or other identification.

DESCRIPTION OF THE PREFERRED EMBODIMENT

Figure 1:
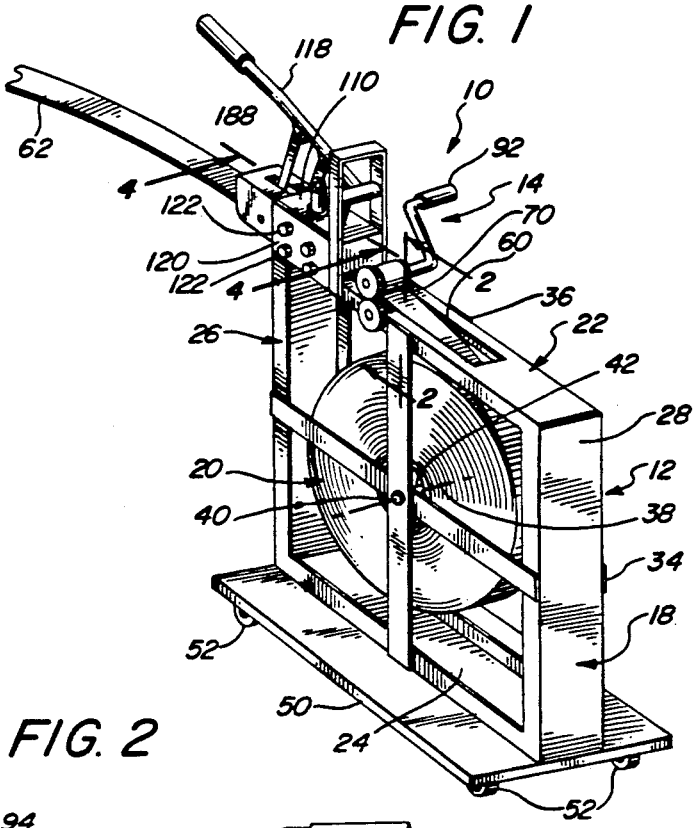
FIG. 1 is a perspective drawing of the combination sheet metal braking, punching and shearing apparatus of the present invention, showing overall features thereof.

There is depicted in FIG. 1 a combination sheet metal strip bending, punching and shearing apparatus 10. According to the present invention, apparatus 10 comprises a sheet metal coil holding reel means 12, a sheet metal strip extracting means 14 and a combination sheet metal strip braking, punching and shearing means 16. Preferably both extracting means 14 and braking, punching and shearing means 16 are mounted onto portions of reel means, as more particularly described below.

Reel means 12 comprises a generally square, rigid frame 18 which is somewhat wider than a coil 20 of sheet metal to be held within the frame. Frame 18 may advantageously be constructed of respective top, bottom, front and rear sections 22, 24, 26 and 28 of C-channel iron, such sections being of equal length. Abutting ends of sections 22, 24, 26 and 28 are joined together, as by welding, to form a rigid, square, open portion of frame 18. Horizontal and vertical cross pieces 34 and 36, are connected across sections 22, 24, 26 and 28 on both sides thereof, such ross pieces overlapping at a central, transverse axis 38 of frame 18. Ends of vertical cross piece 36 are fastened to central, side regions of sections 22 and 24, while ends of horizontal cross piece 4 are fastened to central, side regions of sections 26 and 28. At least one pair of cross pieces 34 and 36 are easily removable from section 22, 24, 26 and 28 to enable the loading of coil 20 into frame 18.

Coil 20 may include a central hub 40 through which a pivot pin 42 extends, the pin extending along axis 38 and through overlapped regions of both pairs of cross pieces 34 and 36 so as to function as an axle for the coil and permit the coil to rotate within frame 18. If coil 20 does not have a central hub 40, pin 42 passes through open central regions of the coil and the coil may hang therefrom. Pin 42 may be retained in frame 18 in any convenient manner, for example, by removable pins which are installed transversely through protruding ends of the pin.

Bottom section 24 is shown in FIG. 1 mounted to a base 50 to the underside corner regions of which are attached wheels 52 to enable apparatus to be easily moved about. An opening 60 is formed in generally central regions of top section 22 to enable a free end length 62 of sheet metal from coil 20 to extend outwardly therethrough.

Figure 2:
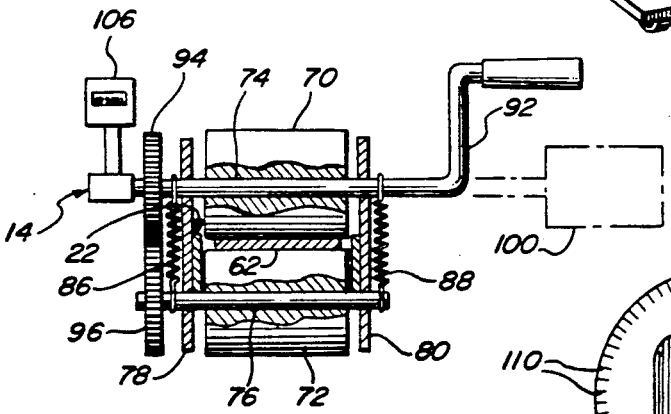
FIG. 2 is a transverse cross sectional drawing looking along line 2—2 of FIG. 1, showing features of the sheet metal strip extracting means.

As best shown in FIG. 2, sheet metal extracting means 14 comprises respective upper and lower rollers or wheels 70 and 72 which are mounted on respective pivot shafts 74 and 76. Roller shafts 74 and 76 are mounted through side plates 78 ad 80 so that adjacent surfaces of rollers 70 and 72 are spaced apart about the thickness of the sheet metal contained on coil 20. Preferably, as shown for side bracket 80 in FIG. 3, shaft 76 of lower roller 72 is mounted through vertically-elongated holes 84 in side brackets 789 and 80. Springs 86 and 88 are connected between shafts 74 and 76 to pull upper and lower rollers 70 ad 72 together so that, in operation, sheet metal strip end portion 62 is tightly squeezed between the rollers. Side brackets are fastened, as by screws 90, to side of frame upper section 22.

Figure 3:
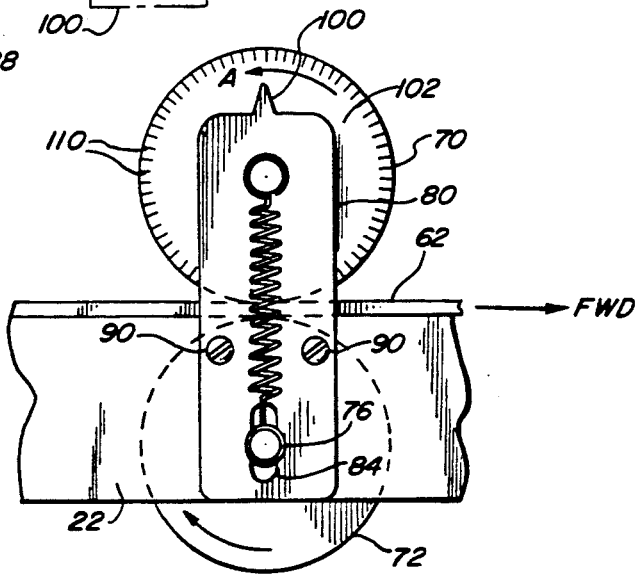
FIG. 3 is a partial side view, taken along line 3—3 of FIG. 2, showing the calibration of an upper roller of the sheet metal extracting means of FIG. 2.

One end of upper roller shaft 74 is connected to a crank 92 (FIGS. 1 and 2) by means of which upper roller 70 can be manually rotated in a direction (direction of Arrow A, FIG. 3) causing strip portion 62 to be pulled from coil 20 and advanced through braking, punching and shearing means 16. Upper and lower gears 94 and 96, respectively, are fixed to ends of upper and lower roller shafts 74 and 76 on the side away form crank 92 (FIG. 3). Gears 94 and 96 are mounted and sized to intermesh so that when upper roller 70 is rotated in one rotational direction of Arrow B, (FIG. 3). As an alternative to crank 92, a motor 100 (shown in phantom lines in FIG. 2) may be connected to upper roller shaft 92 for driving rollers 70 and 72 in a strip-advancing direction.

As shown in FIG. 3, upper roller 70 may be calibrated around the periphery of side 102 to enable the measuring or metering of the length of strip end portion 62 advanced between rollers 70 and 72. Such calibration may be in inches, centimeters, or angles. Assuming that the diameter of upper roller 70 is known, the length of strip portion 62 advanced between rollers 70 and 72 can be determined by the number of fraction of revolutions of the upper roller. As an illustration, if the periphery of upper roller 70 is exactly 15 inches, a strip 30 inches long can be advanced between rollers 70 and 72 by causing the upper roller to be rotated two complete revolutions. To aid in determining the number of roller revolution, upper shaft 74 may be connected to a simple mechanical revolution counter 106 (FIG. 2). Also, or alternatively, side bracket 74 may be formed having a index pointer 108 (FIG. 3) by means of which calibrated markings 110 on upper roller 70 can be read or counted as the upper roller is rotated by crank 92.

Figure 4:
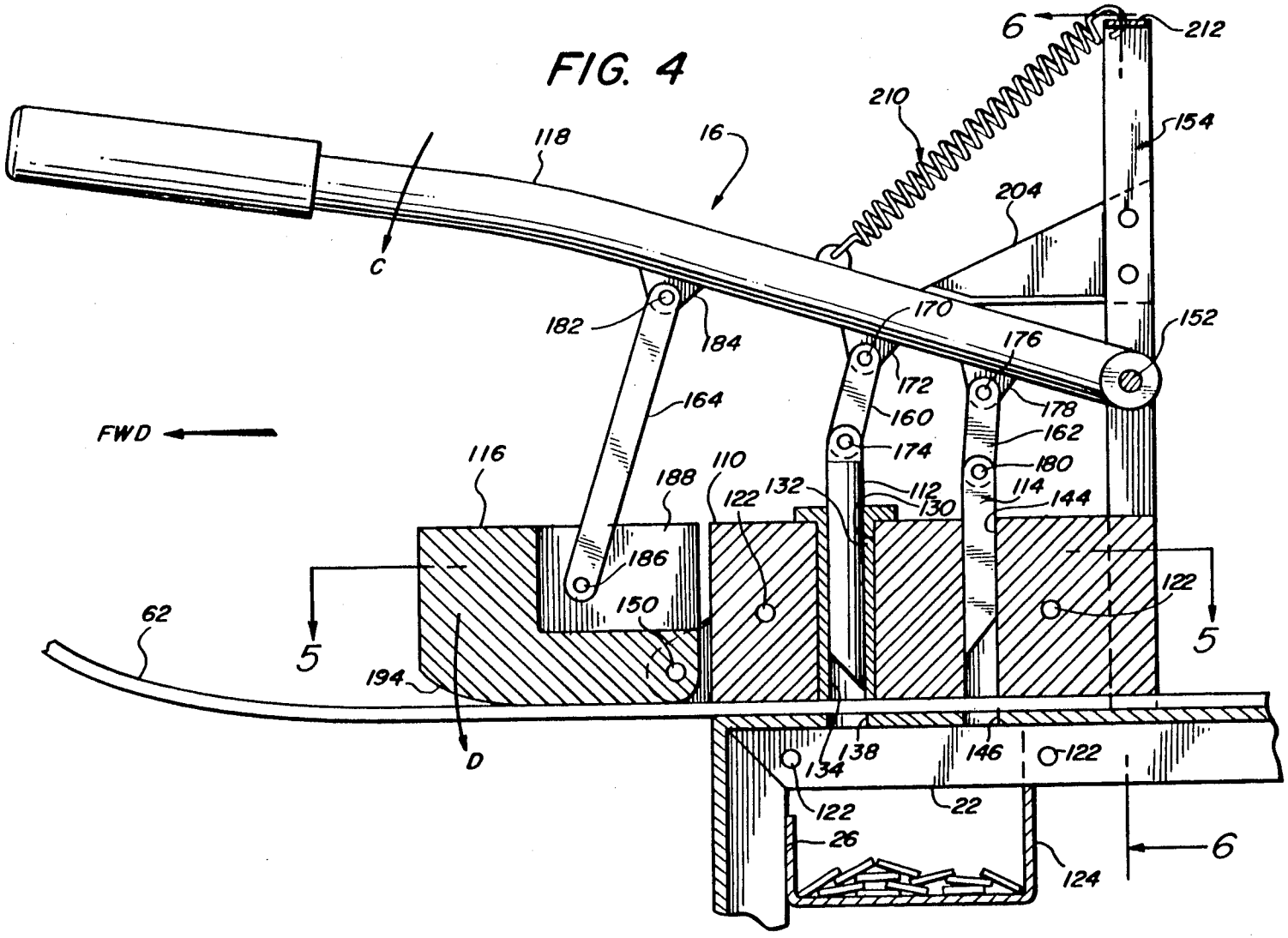
FIG. 4 is a vertical cross sectional drawing looking along line 4—4 of FIG. 1, showing features of the means for braking, punching and shearing sheet metal strips from a coil thereof, and showing such means in the normal, pre-operating condition.
Figure 5:
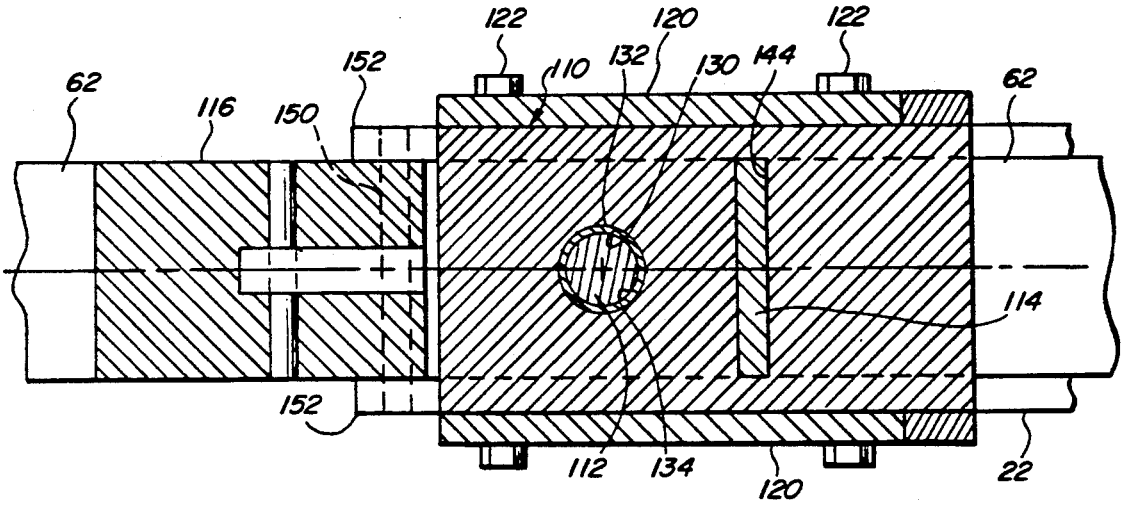
FIG. 5 is a horizontal cross sectional drawing looking along line 5—5 of FIG. 4, showing other features of the means for braking, punching and shearing sheet metal strips from the coil thereof.

Braking, punching and shearing means 16, as best seen from FIG. 4, comprises a mounting block 110, a hole punch 112, a shearing blade 114, a brake or bending block 116 and an operating arm or lever 118. Mounting block is preferably made of steel and is attached by side plates 120 and a plurality of bolts 122 (FIGS. 1 and 5) to an end region of frame upper section 22 adjacent to frame support 26, the mounting block sitting on top of the frame upper section. A rectangular recess 124 (FIG. 6) is formed upwardly into the underside of mounting block 110 in a longitudinal direction. Recess 124 is sized to permit sheet metal strip portion 62 to extend therethrough. FIG. 4 depicts braking, punching and shearing means 16 in a pre or non-operating configuration.

A vertical, cylindrically-shaped aperture 130 is formed through mounting block 110 for receiving a replaceable bushing 132 through an inner aperture 134 of which 112 is received. Bushings 132 with different sizes of apertures 134 may be used for different diameters of punch 112 so that different sized holes 136 (FIGS. 7 and 8) can be punched through sheet metal strip portion 62. Although only one punch 112 and one bushing 132 are depicted (for example, in FIG. 5), it will be understood that more than one punch and bushing may be provided, depending upon the requirements for the number of holes 136 to be punched in the end region of strip portion 62. For example, two punches 112 and corresponding bushings 132 may be provided in a side-by-side relationship to enable the punching of two holes 136 in strip portion 124. In order to enable the punching of holes 136, an aperture 138 (FIGS. 4 and 7) is formed through frame upper section 22 in line with aperture 130 through mounting block 110. A bushing corresponding to bushing 132 may be provided for aperture 138. A detachable receptacle 140 (FIGS. 4 and 7) may be mounted, for example, magnetically, in frame 18 beneath aperture 138 to catch punched-out discs 142 of sheet metal.

Also formed vertically through mounting block 110 is an aperture 144 (FIGS. 4, 5 and 7) for receiving shearing blade 114. Aperture 144 is rectangular in cross section, its walls serving to guide shearing blade 114 when it is operated in a manner shearing sheet metal portion 62 from col 20. Shearing blade aperture 144 is formed closer to sheet metal extracting mans 14 than is punch bushing aperture 130. A mating aperture 146 is formed through frame upper section 22 in line with mounting block aperture 144.

Brake block 116 is pivotally mounted, at a lower corner, to mounting block 110 by a transverse pivot pin 150 which extends through the brake block and forwardly extending ears 152 on the mounting block. Brake block is thereby permitted to pivot, on pin 150 between the horizontal position depicted in FIG. 4 and the vertical (sheet metal braking) position depicted in FIG. 7.

Figures 7, 8:
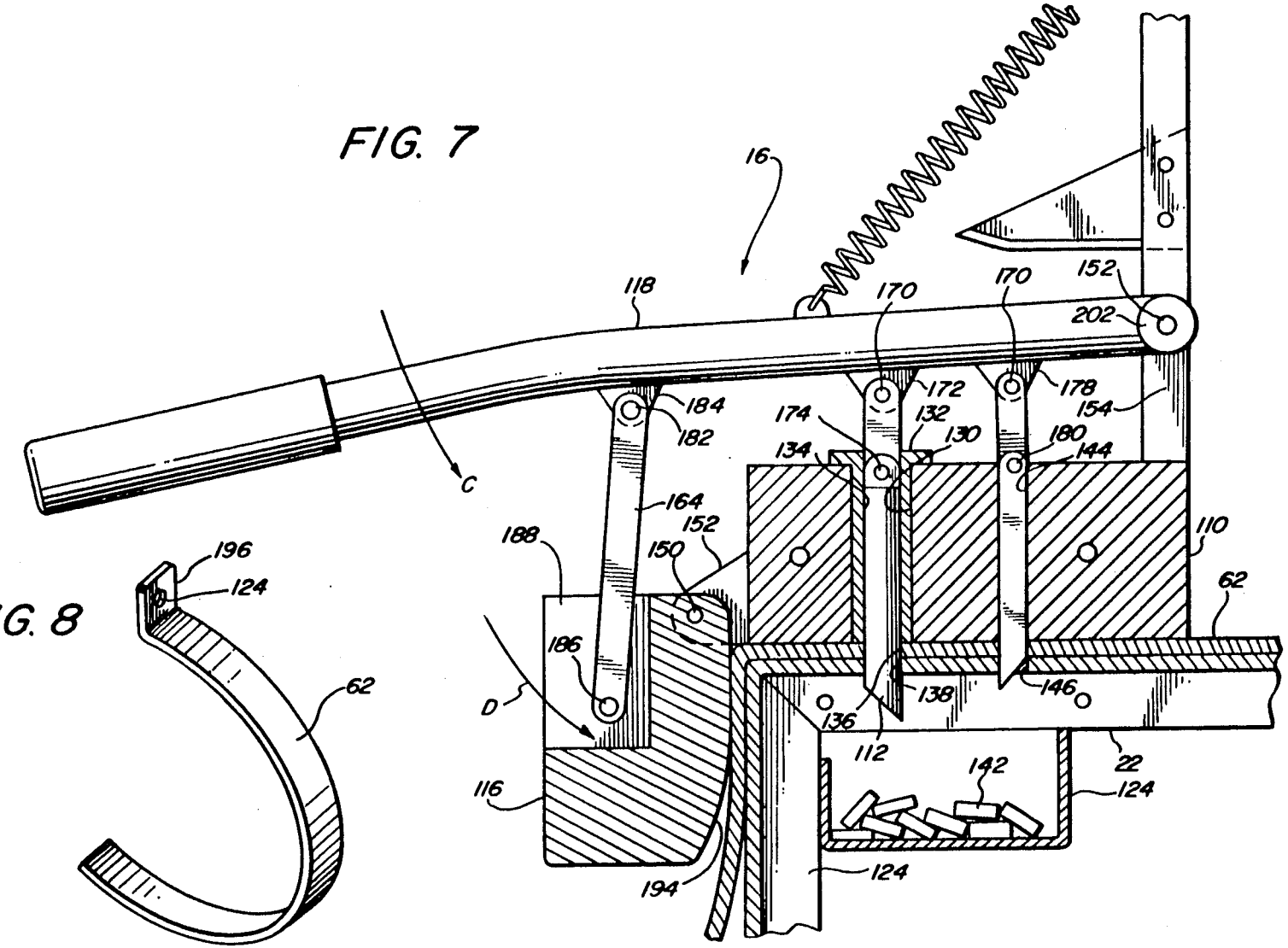
FIG. 7 is a transverse cross sectional drawing in the plane of FIG. 4, showing the braking, punching and shearing means in the operating position in which a strip of sheet metal has been punched, bent through about 90 degrees and sheared from the sheet metal coil.
FIG. 8 is a perspective drawing showing a completed strap which has been formed from a length of sheet metal strip from the sheet metal coil.

Punch 112, shearing blade 114 and brake block 116 are operatively connected to operating arm 118 by respective push rods 160, 162 and 164 (FIGS. 4 and 7). The inner end of operating arm 118 is connected by a pivot pin 152 to a arm mounting member 154, as more particularly described below. Push rod 160 is connected at its upper end region by a pivot pin 170 to ears 172 on arm 118. A lower end region of push rod 160 is connected to upper end regions of punch 112 by a pivot pin 174. Similarly, push rod 162 is connected at its upper end region by a pivot pin 176 to ears 178 on arm 118, a lower end region of the push rod being connected to upper end regions of shearing blade 114 by a pivot pin 180. Also similarly, push rod 164 is connected at its upper end region by a pivot pin 182 to ears 184 on arm 118, a lower end region of the push rod being connected to brake block 116. Forwardly and above pin 150, by a pivot pin 184. A generally rectangular recess 188 is formed into brake block 116 to provide operating clearance for push rod 164.

The positioning of push rod ears 172, 178 and 184 along the underside of operating arm 118, the position of pivot pin 152 on operating arm mounting member 154, and the lengths of respective push rods 160, 162 and 164 are selected in combination with the positioning of punch aperture 130, shear blade aperture 144 and brake block pivot pin 150 to provide the sheet metal punching, shearing and braking operations caused by the downward movement of punch 112, shearing blade 114 and brake block 116 (caused by the rotation of the operating arm in the direction of Arrow C) in the desired sequence and with the same downward strode of the operating arm. In such an operation brake block 116 is caused, by push rod 164, to pivot downwardly, in the direction of Arrow D (FIGS. 4 and 7) so that an under surface 194 of the block pushes against regions of strip portion 62 which extend forwardly just beyond the forward end of frame upper section 22. Under surface 194 of brake block 116 is pivoted downwardly in this manner, strip portion 62 is bent around the corner of frame 18 defined by the junction between frame sections 22 and 26. For forming the preferred bend of about 90 degrees in strip position of FIG. 4 to the vertical position of FIG. 7. If for example, a bend of less than 90 degrees is desired, brake block is caused to pivot through less than 90 degrees.

It is ordinarily desirable to perform the punching operation first so that punch 112 extending through the punched hole 138 in sheet metal strip portion 62 holds such strip portion longitudinally in place while the subsequent shearing and punching operations are performed. It is relatively immaterial which of the shearing and braking operations are then performed; although, it may be easier to construct braking, punching and shearing means 16 so that the braking operation is performed next in sequence as operating arm 118 is pivoted downwardly to the position shown in FIG. 7. With such a punch-brake-shear sequence, the shearing operation cuts the formed strip portion 62 away from coil 20 after the strip has been punched and bent. Such a punched, bent and sheared strip portion 62 is depicted in FIG. 8, a resulting flange 196 being formed at the punched end of the strip portion. As shown in FIG. 8, strip portion 62 may be subsequently curved, for example, during use, into a general C-shape, or into a complete circle.

Relative to the above-described punching, braking and shearing operation of means 16, it will, of course be appreciated that either the punching or braking operation can be omitted by removing or disconnecting either punch 114 or bend block 116.

Figure 6:
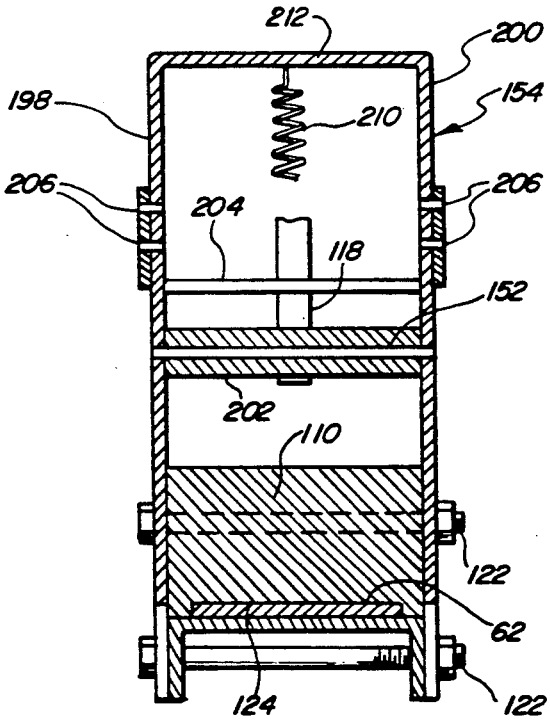
FIG. 6 is a vertical cross sectional drawing looking along line 6—6 of FIG. 4, showing features of a bracket which mounts the operating handle for the braking, punching and shearing means of FIG. 4.

As above mentioned, the end of operating arm 118 nearest frame 18 is pivotally mounted to a mounting member 154 (FIGS. 4, 6 and 7). Preferably, as shown in FIG. 6, member 154 is formed of a rigid metal strip bent into an inverted-U shape. Lower ends of member 154 are connected to mounting block 110 rearwardly of shear blade aperture 144 so that the member is vertically oriented. The joining of member 154 to mounting block 110 may, for example, be by welding or bolting. To enable centering of operating arm 118 between sides 198 and 200 of member 154, the mounting end of the arm is joined to a tubular spacer 202 through which pin 152 extends (FIG. 6).

Advantageously, a stop 204 is attached to member 154 in a position to limit upward travel of operating arm 118 (FIGS. 4, 6 and 7). As shown, stop 204 may be attached between member sides 198 and 200 by screws 206 (FIG. 6). A tension spring 210 is preferably connected between a top section 212 of member 154 and operating arm 118 to return the operating arm to its upward position (FIG. 4) when the arm is released.

Although there is described above a specific arrangement of apparatus for braking, punching and shearing strips of sheet metal into individual straps in accordance with the present invention for the purpose of illustrating the manner in which the invention an be used to advantage, it is to be appreciated that the invention is not limited thereto. Accordingly, any and all variations and modifications which may occur to those skilled in the art are to be considered to be within the scope and spirit of the invention as defined by the appended claims.

What is claimed is:

1. Apparatus for forming strips of sheet metal, said apparatus comprising:

a. reel means for holding a coil of sheet metal for being formed into strips;

b. sheet metal strip feeding means associated with said reel means for extracting lengths of sheet metal from a coil of sheet metal held therein, said extracting means enabling the extracting of predetermined lengths of sheet metal strips from said col of sheet metal; and, c. combination punching and sharing means associated with said feeding means for punching at least one hole in each of said extracted lengths of sheet metal and for shearing each of said extracted lengths of sheet metal from said coil, said combination punching and shearing means being configured for causing said punching and said shearing with a single operational stroke thereof, said combination punching and shearing means including braking means for causing the bending over of one region of each of said extracted lengths of sheet metal relative to the rest of each extracted length before said extracted length of sheet metal is sheared from the coil of sheet metal.

2. The apparatus as claimed in claim 1, wherein said combination punching and shearing means are configured for punching a hole in each of said extracted lengths of sheet metal relatively adjacent to the line at which said extracted lengths of sheet metal is to be sheared from said coil of sheet metal.

3. The apparatus as claimed in claim 1, wherein the punching and shearing means are configured for punching a hole in each of said extracted lengths of sheet metal before said extracted length is sheared from the coil of sheet metal.

4. The apparatus as claimed in claim 1, wherein said combination punching and shearing means are configured for enabling different sizes of hole punches to be installed therein, whereby holes of different sizes may be punched thereby through said extracted lengths of sheet metal.

5. The apparatus as claimed in claim 1, wherein said combination punching and shearing means are mounted on said reel means.

6. The apparatus as claimed in claim 1, wherein said region which said braking means bends over is relatively adjacent to the line at which each of said extracted lengths of sheet metal is to be shared from coil of sheet metal.

7. The apparatus as claimed in claim 6, wherein said braking means bends over each of said extracted lengths of sheet metal so that said at least one punched hole is between the bend made by the bending means and the line at which said extracted length is sheared off from said coil of sheet metal in the same bending, punching and shearing operation.

8. The apparatus as claimed in claim 1, wherein said braking means is configured for causing a bend of about 90 degrees in said extracted lengths of sheet metal.

9. The apparatus as claimed in claim 1, wherein said feeding means comprise a pair of rollers between which sheet metal from the coil is passed so as to be advanced from the coil in response to rotation of said rollers in a strip advancing direction.

10. The apparatus as claimed in claim 9, wherein said feeding means include means for causing the rotation of said rollers in a sheet metal advancing direction, the rotation of said rollers being calibrated so that a given rotation of the rollers causes the extraction of a known length of sheet metal from the coil.

11. The apparatus as claimed in claim 1, wherein said combination braking, punching and shearing mans are configured for enabling different sizes of hole punches to be installed therein, whereby holes of different sizes may be punched thereby through said extracted lengths of sheet metal.

12. The apparatus as claimed in claim 1, wherein the combination braking, punching and shearing means are mounted on said reel means.

13. The apparatus as claimed in claim 1, wherein said feeding means comprise a pair of rollers between which sheet metal from the coil is passed so as to be advanced from the coil in response to rotation of said rollers in a strip advancing direction and including means for causing the rotation of said rollers in a sheet metal advancing direction, the rotation of the rollers causes the extraction a known length of sheet metal from the coil.

* * * * *